US005228569A

United States Patent [19]

House

[11] Patent Number: 5,228,569

[45] Date of Patent: Jul. 20, 1993

[54] STACKING AND STORING CONTAINER FOR CHUCKS FOR MACHINING OPTIC LENS

[76] Inventor: Mortimer E. House, 8869 Balboa Ave., San Diego, Calif. 92123

[21] Appl. No.: 962,720

[22] Filed: Oct. 19, 1992

[51] Int. Cl.[5] ..... B65D 85/58

[52] U.S. Cl. ..... 206/372; 206/445; 206/499; 220/630; 220/504; 220/507

[58] Field of Search ..... 206/372, 379, 349, 316.1, 206/445, 83, 84, 427, 499; 220/625, 629, 630, 345, 346, 525, 507, 504; 211/49.1, 14; 294/159, 162, 163

[56] References Cited

U.S. PATENT DOCUMENTS

| | | | |
|---|---|---|---|
| 2,247,620 | 7/1941 | Robinson | 206/427 |
| 4,143,765 | 3/1979 | Moss, III | 206/445 |
| 4,738,363 | 4/1988 | Hudson | 206/427 |
| 4,789,062 | 12/1988 | Walsh | 294/162 X |

*Primary Examiner*—Steven N. Meyers

*Assistant Examiner*—Jacob K. Ackun, Jr.

*Attorney, Agent, or Firm*—Frank D. Gilliam

[57] ABSTRACT

A stacking and storage container for metal chucks used in machining optic lens comprising a housing formed with a top and bottom surface interconnected with a plurality of tubes with openings into the tubes through the top and bottom. The top, bottom and tubes are constructed of a material such as plastic that does not transfer heat or cold. Slides are positioned along opposing sides of the bottom for receiving a plate for covering the bottom opening of the tubes when positioned along the slides covering the bottom surface. The slides and bottom plate are constructed of a heat and cold conducting material such as metal. The chucks when placed within the tubes with the bottom plate installed covering the bottom openings of the tubes are cooled by placing the container on a cold surface or in a refrigerator whereby the cold is transferred through the plate and slides to the chucks therein. The cold chucks are removed for use by sliding the plate from bottom of the tubes.

8 Claims, 1 Drawing Sheet

STACKING AND STORING CONTAINER FOR CHUCKS FOR MACHINING OPTIC LENS

BACKGROUND OF THE INVENTION

The invention is directed to a container and more particularly to a container for stacking and storing chucks which are attached to an optic lens for machining of that lens.

In the optic lens art and especially in the plastic lens art, the lens are attached to a chuck for machining to the desired optic configuration. The chucks are refrigerated to a low temperature, one surface of a plano or prism ring is attached to a lens and the other side of the ring is attached to the chuck. Between the chuck and the lens an open space exists. This open space is filled with a low melting temperature metal, well known in this art, and allowed to cool and harden. After the metal has hardened the chuck is mounted in an appropriate machine for fine optical machining. The temperature of the refrigerated chuck acts as a heat sink taking heat from the liquid metal to prevent harm to the lens attached thereto.

After the machining process is completed, the lens is removed and the ring and chuck are placed in an oven or water heated above the melting temperature of the low melt metal and the chuck, ring and metal are salvaged for reuse.

A problem exists in that the chucks after use must be collected, individually stacked and placed in a refrigerator or on a refrigerated surface to reduce their temperature for re-use. The collecting and stacking of the individual chucks is a time consuming task and requires a person to go from work station to work station to collect and stack the chucks for placement in a refrigerator or refrigerated surface for re-use as fore mentioned.

There has not been a satisfactory solution to this time consuming problem until the emergence of the present invention.

SUMMARY OF THE INVENTION

The invention is directed to an optic lens machining chuck stacking and storing device. The device of this invention can be positioned at each work station of a multi-work station optic lens manufacturing or machining establishment so that the operator of that station can deposit a plurality of chucks after use wherein the chucks are stacked, can be transported in quantity to a refrigerator or refrigerated surface and delivered back to a work station refrigerated for re-use.

The device includes a plurality of hollow tubes secured to and through a bottom surface and a top surface. The tubes and top and bottom surfaces are constructed of a non-heat/cold conducting material. The metal chucks can be dropped through the open top surface into the tubes. A selectively removable metal plate is positioned over the bottom surface openings through the bottom plate to prevent the vertical stacked chucks from normally falling through the tubes. When the tubes are filed with the desired quantity of chucks, the device is carried to a refrigerator or cold surface to chill the chucks for further use. The metal plate is inserted within a metal track positioned on each side of the bottom surface until it contacts a centrally positioned stop member at the opposite end of the bottom plate. A ring centrally located on the distal end opposite the inserted end of the metal plate is used to withdraw the plate from the slides and the bottom plate.

The metal slides and plate conducts the cold from the refrigerator or cold plate to the stacked metal chucks. The materials of construction of the top and bottom and tubes insulates the cold chucks from the atmosphere and maintains the chucks at a desired temperature for a long period of time.

A object of the invention is to provide a means for stacking, transporting and chilling optical lens chucks for lens machining.

An other object of the invention is to maintain the metal chucks at a desired reduced temperature for a long period of time absent the refrigerant source.

Another object is to provide a device for easy removal of the stacked chucks and maintaining that stacked condition after chilling for re-use.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

DESCRIPTION OF THE PREFERRED EMBODIMENT

Figure 1:
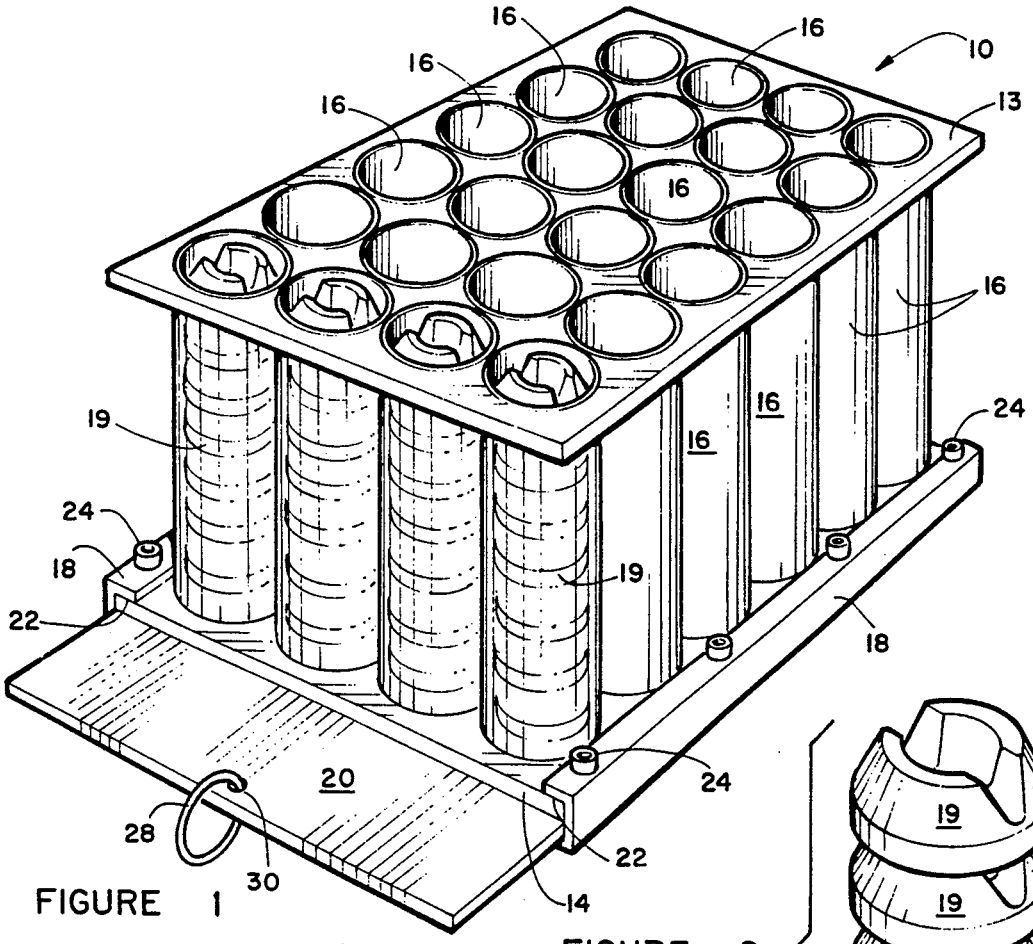
FIG. 1 is an elevated perspective view of the device of the invention with a quantity of metal chucks contained in the tubes of the device and the bottom metal plate partly removed from the body of the device.
Figure 3:
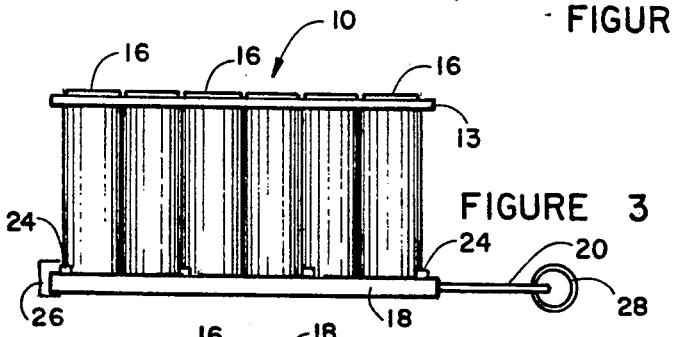
FIG. 3 is a side view of the FIG. 1 showing.
Figure 4:
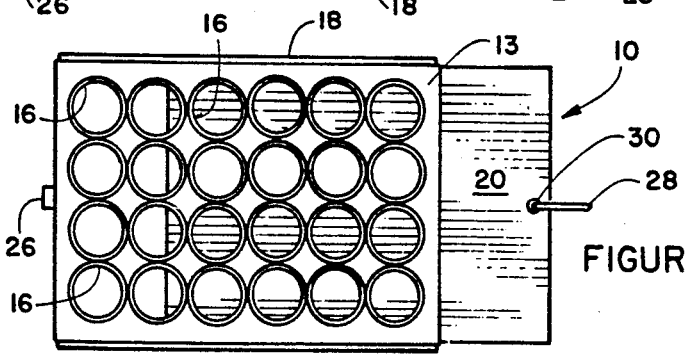
FIG. 4 is a top plan view of the showing of FIG. 1.

Referring now to the various drawing figures, FIG. 1, 3 and 4 show an elevated perspective view, a side view and a top plan view respectfully of the device of the invention. FIG. 1 depicts a quantity of metal chucks 19 contained in the tubes 16 of the device and the bottom metal plate 20 partly removed from the body of the device depicts the carrying and stacking device 10 of the invention.

The device 10 includes a top 13 and a bottom 14 interconnected with a plurality of side-by-side cylindrical tubes 16. The tubes are fixedly attached to the top and bottom surface so that the tubes are open at both ends. The top and bottoms are preferably constructed from a highly insulating material such as transparent plastic or the like. However, any material transparent or material otherwise suitable to practice the intent of this invention may be used to practice this invention. Along two opposing sides of the bottom plate includes a track 18 constructed from a cold conductive metal such as aluminum, copper or the like that is durable for repeated use as herein after mentioned. A metal plate 2 is configured to slide within the tracks 18. The tracks are dimensioned and position mounted to the bottom plate 14 so that the metal plate 20 abuts the distal surface of he bottom plate when sliding in the tracks and when in position covering the entire surface of the bottom and tube openings.

The tracks 18 are generally rectangular "C" shaped with the openings facing each other and secured over the outer upper edge surface 22 by means of a screw 24 threadedly engaging bottom 14. Any suitable means may be used to attach the tracks to the bottom surface for the purpose intended.

To prevent the metal plate 20 from being inserted to far into slides 18, a stop member 26 is attached to one surface of the bottom 14 to prevent the metal plate from being inserted through and beyond the outer surface of the bottom surface.

For ease of removal of the metal plate 20 when installed under the bottom surface 14, a pull ring 28 is loosely connected to the metal plate through aperture 30.

Figure 2:
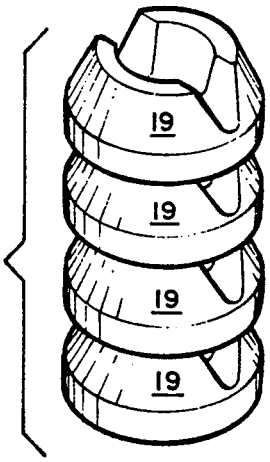
FIG. 2 is an elevated perspective showing of the chucks for which the device is intended to carry and store.

A stack of typical metal chucks 19 are shown in FIGS. 1 and 2.

It should be understood that various differently configured chucks could be accommodated in the device in the manner discussed herein.

While a specific embodiment of the optic lens chuck holder has been shown and fully explained above for the purpose of illustration it should be understood that many alterations, modifications and substitutions may be made to the instant invention disclosure without departing from the spirit and scope of the invention as defined by the appended claims.

What is claimed is:

1. A stacking and storing container for chucks for machining optic lens comprising:

a top and bottom surface formed of thermal insulating material;

a plurality of cylindrical tubes extending between said top and said bottom surface, said cylindrical tubes having a diameter slightly larger than the diameter of said chucks for receiving said chucks therein, being open at each end thereof and formed of thermal insulating material;

slide members formed of thermal conducting material along opposing sides of said bottom surface and attached thereto; and a plate formed of thermal conducting material insertable into said slide members for closing the adjacent opening into said plurality of cylindrical tubes said top and bottom surface and said cylindrical tubes being made of a material more insulative than the material of said slide members and said plate.

2. The stacking and storing container as defined in claim 1 wherein said top and bottom surface and cylindrical tubes are constructed of plastic.

3. The stacking and storing container as defined in claim 1 wherein said top and bottom surface and cylindrical tubes are transparent.

4. The stacking and storing container as defined in claim 2 wherein said top and bottom surface and cylindrical tubes are transparent.

5. The stacking and storing container as defined in claim 1 wherein said slide members are formed of metal.

6. The stacking and storing container as defined in claim 1 wherein said plate is formed of metal.

7. The stacking and storing container as defined in claim 1 additionally comprising a stop means for preventing said plate from being inserted more than a selected distance along said slide members.

8. The stacking and storing container as defined in claim 1 additionally comprising a pulling member for removing said plate from said slide members.

* * * * *